US006174268B1

(12) United States Patent
Novak

(10) Patent No.: US 6,174,268 B1
(45) Date of Patent: Jan. 16, 2001

(54) ENERGY ABSORBING SYSTEM FOR EXERCISE EQUIPMENT

(76) Inventor: Pat J. Novak, 3026 River Oaks Dr. NE., North Liberty, IA (US) 52317

( * ) Notice: Under 35 U.S.C. 154(b), the term of this patent shall be extended for 0 days.

(21) Appl. No.: 09/240,076

(22) Filed: Jan. 29, 1999

(51) Int. Cl.[7] ..... A63B 22/02

(52) U.S. Cl. ..... 482/54; 482/51

(58) Field of Search ..... 482/51, 54

(56) References Cited

U.S. PATENT DOCUMENTS

| | | | | |
|---|---|---|---|---|
| 5,441,468 | * | 8/1995 | Deckers et al. | 482/54 |
| 5,976,061 | * | 11/1999 | Moon et al. | 482/54 |
| 6,013,011 | * | 1/2000 | Moore et al. | 482/51 |

* cited by examiner

*Primary Examiner*—Glenn E. Richman

(57) ABSTRACT

An exercise device has a resilient member disposed in series between a body supporting member and an underlying floor surface. The resilient member is selectively rotated relative to the body supporting member to adjust the energy absorbing characteristics of the resilient member.

14 Claims, 7 Drawing Sheets

Fig. 9a
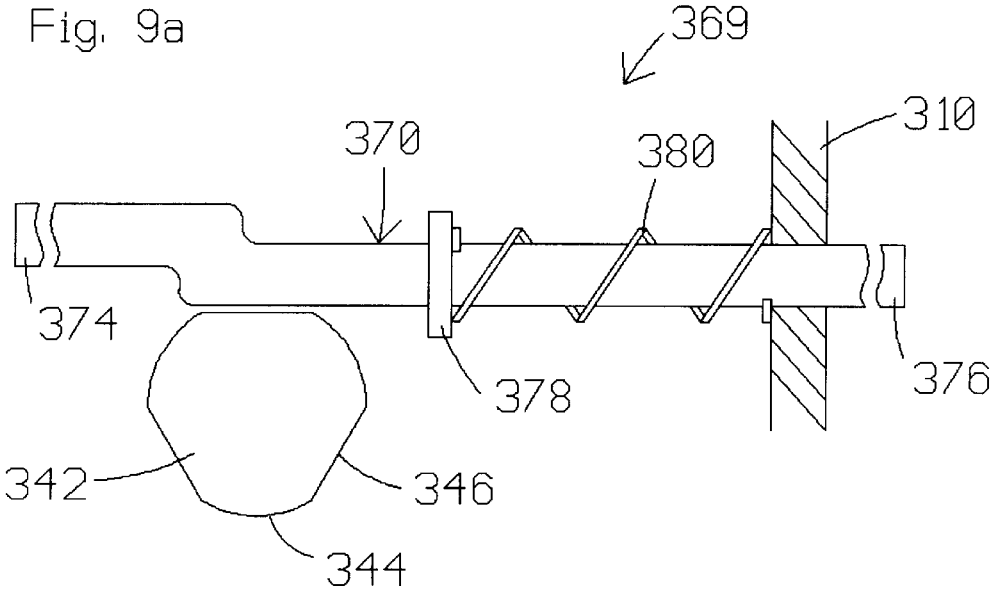
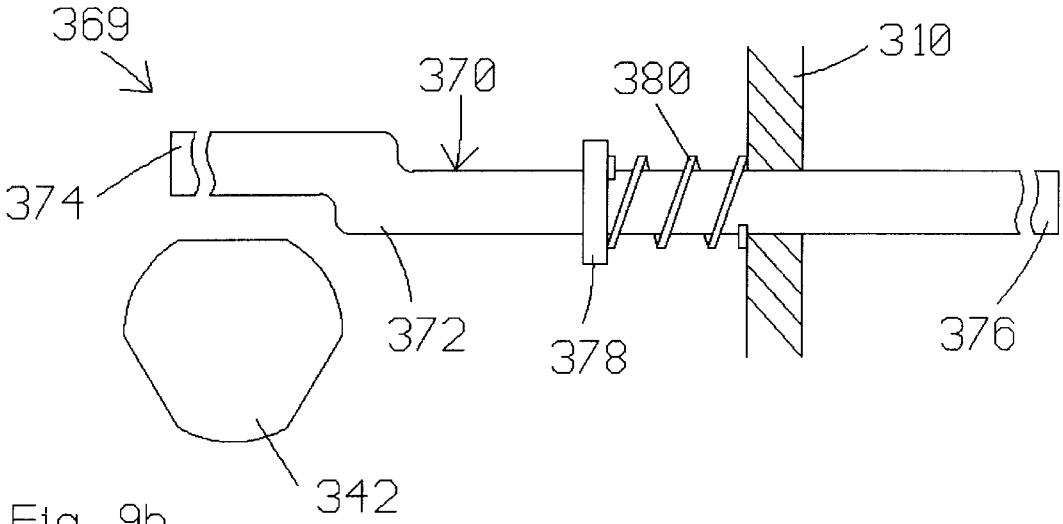
Fig. 9b

ENERGY ABSORBING SYSTEM FOR EXERCISE EQUIPMENT

FIELD OF THE INVENTION

The present invention relates to exercise equipment, and more specifically, to methods and apparatus for absorbing energy associated with exercise movement.

BACKGROUND OF THE INVENTION

One of many factors to be considered in the design of exercise equipment is energy absorption. On treadmills, for example, impact is created each time a person's foot lands on the tread and/or deck. In the absence of an energy absorption system, the impact rebounds into the person's foot and may cause harmful stress to the person's joints. In recognition of this potential problem with treadmills, equipment designers have developed systems to absorb or dissipate the impact so that it does not rebound into the exerciser's feet and legs. Examples of such systems are disclosed in U.S. Pat. No. 4,350,336 to Hanford and U.S. Pat. No. 5,382,207 to Skowronski et al. Despite these advances in the art, room for improvement remains.

SUMMARY OF THE INVENTION

The present invention provides an improved energy absorbing system for exercise equipment. On a preferred embodiment treadmill, the system is disposed between the deck and the frame and adjusts to accommodate the various needs of different users. Additional features and/or advantages of the present invention will become apparent from the detailed description which follows.

BRIEF DESCRIPTION OF THE DRAWING

With reference to the Figures of the Drawing, wherein like numerals represent like parts and assemblies throughout the several views.

FIG. 9*a* is a diagrammatic side view of an adjustment assembly suitable for use on the treadmill of FIG. 6; and FIG. 9*b* is a diagrammatic side view of the adjustment assembly of FIG. 9*a* in a second configuration.

DETAILED DESCRIPTION OF THE PREFERRED EMBODIMENT

Figure 1:
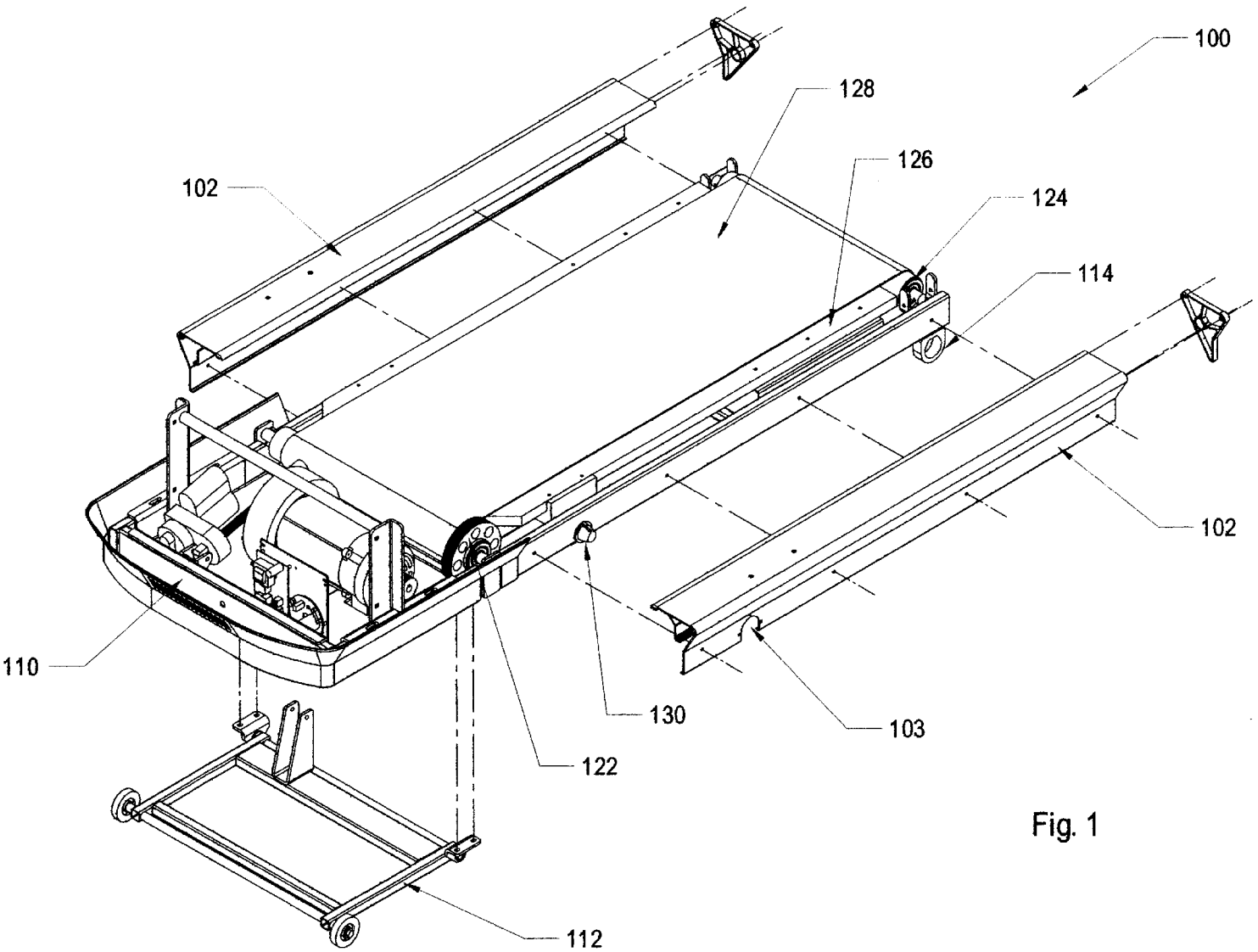
FIG. 1 is a partially exploded, perspective view of an exercise treadmill constructed according to the principles of the present invention.

A preferred embodiment treadmill constructed according to the principles of the present invention is designated as 100 in FIG. 1. Recognizing that the treadmill 100 is conventional in many respects, and further, that the invention is not limited to any particular type of exercise equipment, the following description will focus primarily on the novel energy absorbing system provided on the treadmill 100.

Generally speaking, the treadmill 100 includes a frame 110 which is supported relative to an underlying floor surface by means of a front elevation adjustment assembly 112 and rear legs 114. Front and rear rollers 122 and 124 are rotatably mounted on the frame 110, and a deck 126 is mounted on the frame 110 between the rollers 122 and 124. An endless belt 128 is trained about the rollers 122 and 124 and the deck 126, and the upwardly facing portion of the belt 128 is supported by the deck 126.

Figure 2:
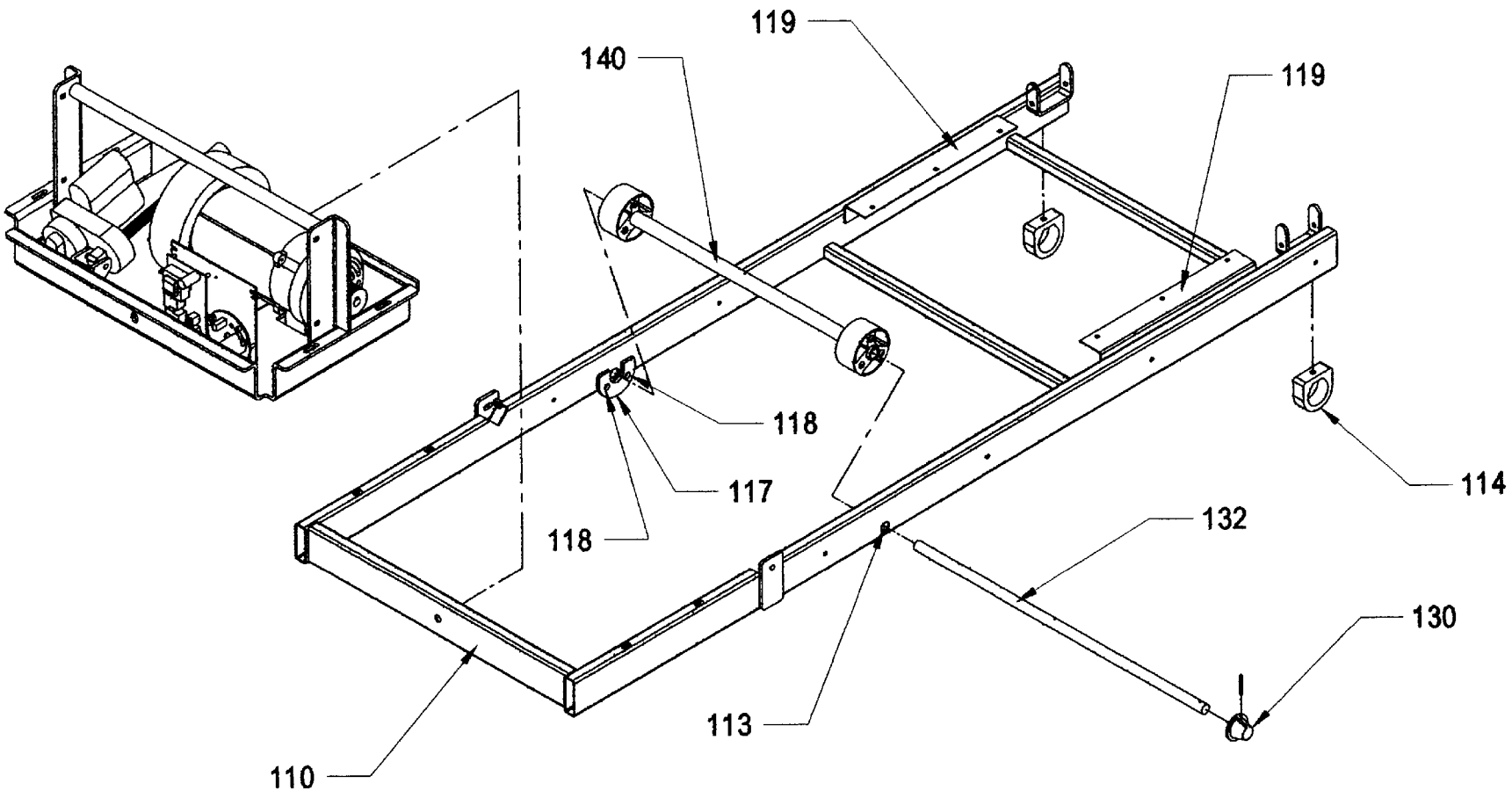
FIG. 2 is a partially exploded, perspective view of certain components on the treadmill of FIG. 1.

Some of the components of the treadmill 100 are shown more clearly in FIG. 2. L-shaped brackets 119 are secured to the rear portion of the frame 110 to support a rearward portion of the deck 126. An energy absorbing assembly 140 is mounted on an intermediate portion of the frame 110 to support a forward portion of the deck 126.

Figure 3:
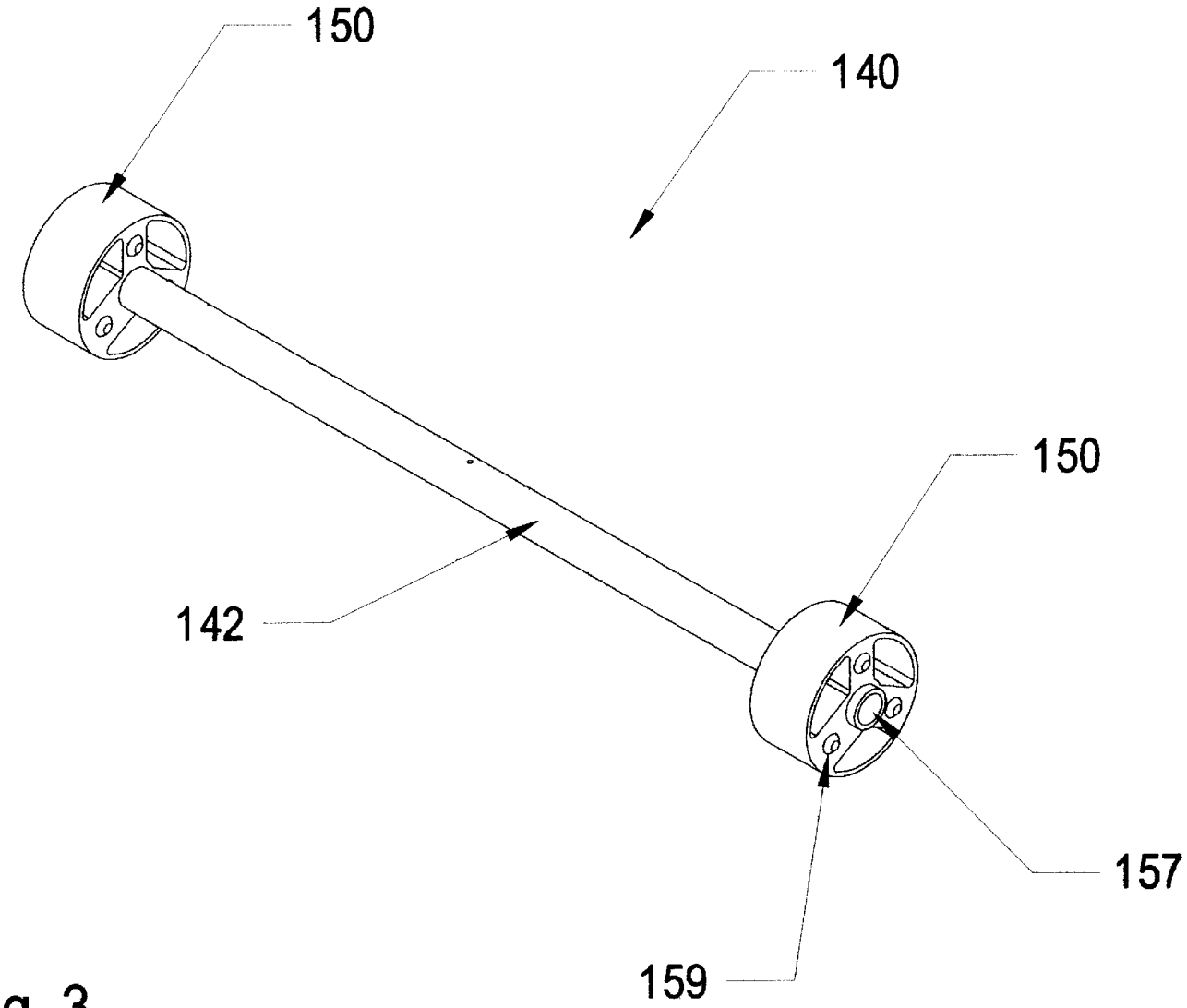
FIG. 3 is a perspective view of an energy absorbing assembly on the treadmill of FIG. 1.

As shown in FIG. 3, the energy absorbing assembly 140 includes opposite side energy absorbers 150 interconnected by a shaft 142. The assembly 140 is disposed between opposite sides of the frame 110 and secured in place by a rod 132 extending through holes 113 is the sides of the frame 110. A knob 130 is keyed to one end of the rod 132, which in turn, is keyed to the shaft 142. The resulting assembly is rotatable relative to the frame 110 for reasons explained below. As shown in FIG. 1, the knob 130 is accessible to a user via an opening 103 in one of the side rails 102 on the frame 110.

Figure 4:
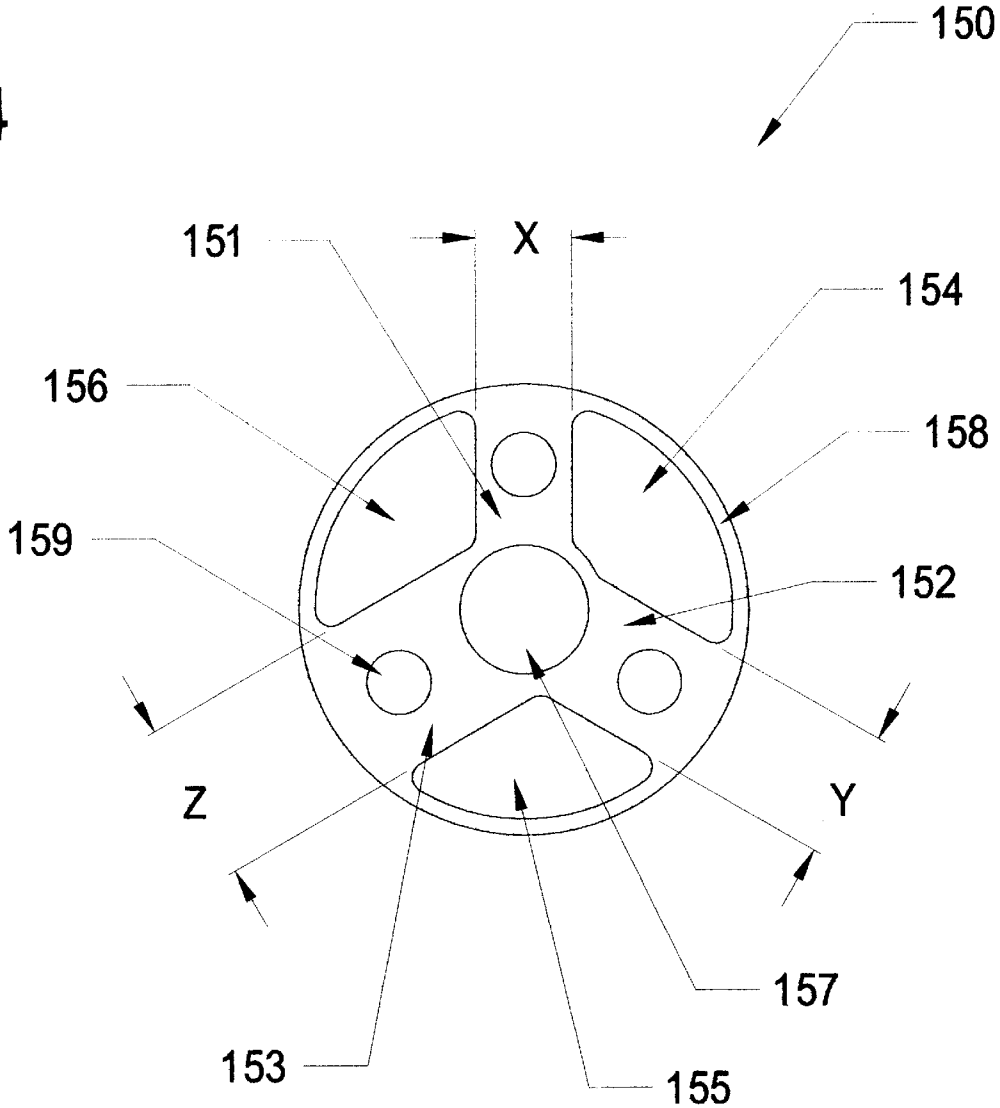
FIG. 4 is a side view of an energy absorbing member on the assembly of FIG. 3.

One of the energy absorbing members 150 is shown in FIG. 4. Each of the energy absorbing members 150 may be described as a cylindrical member having radially extending spokes 151–153 and/or axially extending openings 154–156. In other words, the spokes 151–153 may be described as defining openings 154–156 therebetween, and the openings 154–156 may be described as defining spokes 151–153 therebetween. In either case, the spokes 151–153 converge at a central hub disposed about an axially extending hole 157 having an inside diameter of approximately one inch. Opposite, distant ends of the spokes 151–153 are interconnected by a circumferential rim 158 having an outside diameter of approximately three and one-half inches. A nub 159 projects outward from each of the spokes 151–153 for reasons explained below. Each of the nubs 159 is disposed an equal radial distance from the center of the energy absorbing member 150, and is angularly displaced an equal distance from each of the adjacent nubs 159.

Each of the energy absorbing members 150 is made of an elastomeric material, such as synthetic or natural rubber. In particular, it is believed that a 50 durometer, A shore, silicon rubber provides desirable results. The members 150 are preferably integrally formed and vulcanized to the shaft 142.

Each of the spokes 151 has a thickness X of approximately three-quarters of one inch, as measured perpendicular to a first radius emanating from the cylindrical axis of the member 150. Each of the spokes 152 has a thickness Y of approximately one inch, as measured perpendicular to a second radius emanating from the cylindrical axis of the member 150. Each of the spokes 153 has a thickness Z of approximately one and one-quarter inches, as measured perpendicular to a third radius emanating from the cylindrical axis of the member 150.

As a result of the different spoke thicknesses, the energy absorption of each member 150 is a function of the member's orientation relative to the deck 126. For example, when the members 150 are oriented as shown in FIG. 4 (with the relatively thin spokes 151 disposed directly between the deck 126 and the shaft 142), the assembly 140 is relatively more sensitive but has less capacity to absorb energy during exercise. If the assembly 140 is rotated so that relatively larger spokes 152 or 153 are disposed directly between the deck 126 and the shaft 142, then the assembly 140 is relatively less sensitive but has more capacity to absorb energy during exercise. As a result, the assembly 140 may be adjusted to accommodate people of different sizes and/or people with different exercise needs. In this regard, the "X", setting is better suited for a relatively light person who wishes to walk on the treadmill, whereas the "Z" setting is better suited for a heavy person who wishes to run on the treadmill.

Semi-circular brackets 117 are mounted on opposite sides of the frame 110 and surround the lower half of each of the holes 113. The brackets 117 are provided with openings 118 which are sized and configured to receive the nubs 159 on the energy absorbing members 150. The openings 118 cooperate with the nubs 159 to provide a detent system which encourages the members 150 to remain in one of three orientations relative to the frame 110. In other words, a user must turn the knob with force sufficient to overcome the bias of the detent system, in order to adjust the energy absorbing characteristic of the treadmill 100.

Those skilled in the art will recognize that it may be desirable to provide low friction coatings on the outside of the members 150 and/or the downwardly facing side of the deck 126, in order to facilitate rotation of the former relative to the latter. Another way to facilitate relative rotation is to dispose one or more idler rollers between the deck 126 and each of the members 250.

The present invention may alternatively be described in terms of a method of absorbing energy associated with exercise movement. In one such method, an energy absorbing member is disposed between a treadmill deck and a treadmill frame. The energy absorbing member is then selectively rotated relative to the frame to adjust capacity and/or sensitivity of the energy absorbing member.

Figure 5:
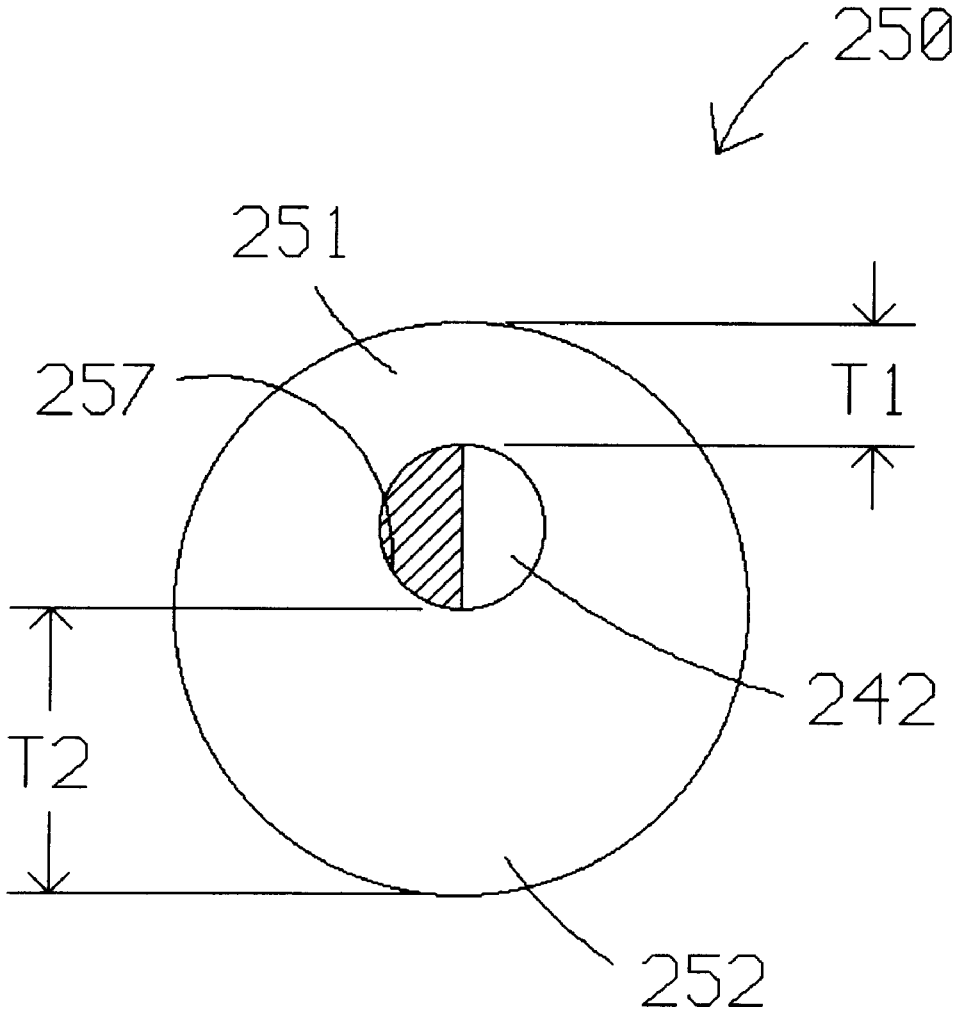
FIG. 5 is a side view of an alternative embodiment energy absorbing member suitable for use on the assembly of FIG. 3.

Those skilled in the art will also recognize that the present invention may be modified and/or applied in a variety of ways. For example, an energy absorbing member having an alternative configuration is designated as 250 in FIG. 5. The member 250 may be described as a cylinder having an offset bore 257 which receives a shaft 242. In a first orientation relative to a treadmill frame, a relatively small amount of energy absorbing material 251, having a thickness T1, is disposed between the shaft 242 and an overlying treadmill deck. In a second orientation relative to the frame, a relatively large amount of energy absorbing material 252, having a thickness T2, is disposed between the shaft 242 and the deck.

Figure 6:
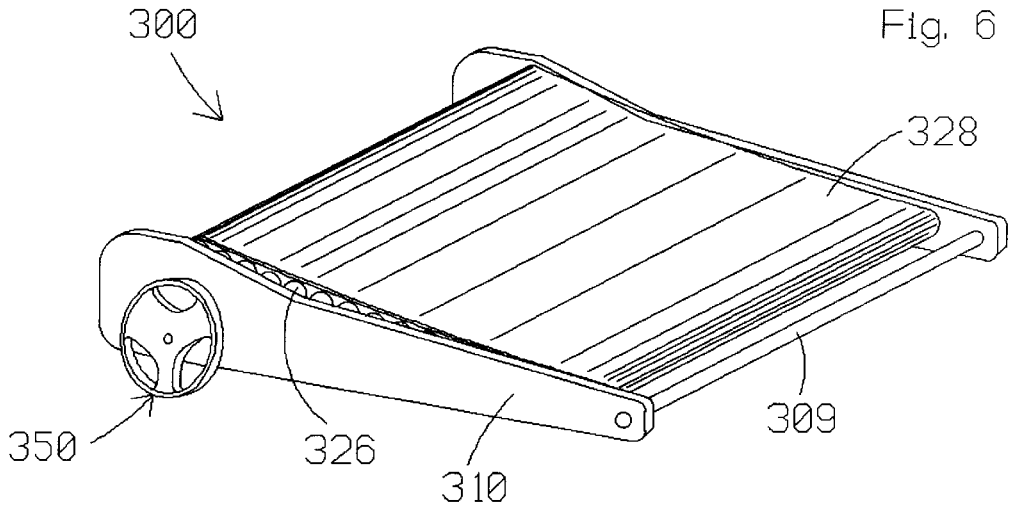
FIG. 6 is a perspective view of another treadmill constructed according to the principles of the present invention.
Figure 8:
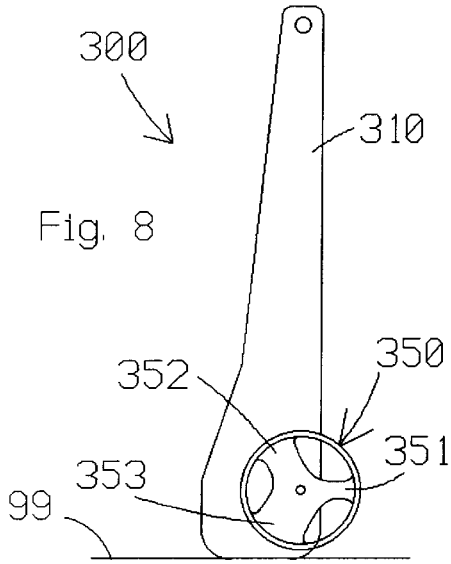
FIG. 8 is a side view of the treadmill of FIG. 6 in a storage orientation relative to an underlying floor surface.
Figure 7:
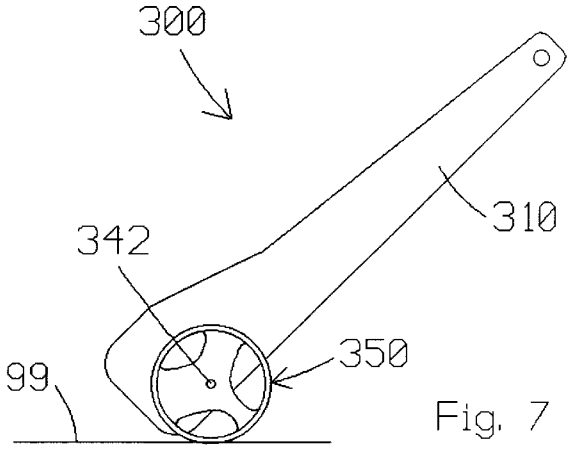
FIG. 7 is a side view of the treadmill of FIG. 6 in a mobilized orientation relative to an underlying floor surface.

An alternative embodiment treadmill 300 with left and right energy absorbing members 350 is shown in FIGS. 6–8. With the exception of the energy absorbing members 350, the treadmill 300 is similar to the treadmill disclosed in U.S. Pat. No. 3,642,279 to Cutter, which is incorporated herein by reference. On this embodiment 300, an endless tread 328 is disposed about a deck comprised of a plurality of adjacent rollers 326. The energy absorbing members 350 are mounted on opposite ends of a shaft 342 and disposed between the frame 310 and the underlying floor surface. In this context, each of the members 350 may be described as a wheel, as well as an energy absorber. Thus, the members 350 provide both a means for absorbing energy associated with exercise and a means for moving the treadmill across an underlying floor surface.

The wheels 350 are relatively larger than the energy absorbing members 150, in part because they are supporting more mass, and in part to facilitate travel across a floor surface. As illustrated in FIGS. 6–8, the wheels 350 are mounted on the frame 310 in such a manner that they engage the floor surface 99 except when the frame 310 is positioned in a vertical storage orientation, resting on the forward end of the frame 310. A handle 309 is provided on the rear end of the frame 310 to facilitate movement of the treadmill 300 into and out of the storage orientation.

Like the energy absorbing members 150 described with reference to the first embodiment 100, the wheels 350 have three spokes 351–353 which have different widths. When the wheels 350 are oriented as shown in FIG. 6, the smallest width spoke 351 is disposed between the shaft 342 and the floor surface, and the system is more sensitive but has less capacity, as compared to when another of the spokes 352–353 is disposed between the shaft 342 and the floor surface.

Those skilled in the art will recognize the desirability of selectively locking the wheels 350 against rotation relative to the frame 310. One of many possible locking mechanisms is designated as 369 in FIGS. 9*a*–9*b*. The mechanism 369 includes a bar 370 which is movable axially relative to the frame 310. The bar 370 includes an engaging portion 372 and an offset portion 373. The bar 370 is aligned with a machined segment of the wheel shaft 342. In particular, three flat surfaces 346 have been cut into the otherwise circular outer surface 344 of the shaft 342. Adjacent surfaces 346 define an angle of one hundred and twenty degrees therebetween.

When the bar 370 is in its locked position (FIG. 9*a*), the engaging portion 372 closely parallels one of the surfaces 346 and thereby prevents rotation of the shaft 342. When the bar 370 is moved to its unlocked position (FIG. 9*b*), the offset portion 373 displaces the engaging portion 372 relative to the shaft 342, thereby freeing the shaft 342 for rotation. A helical coil spring 380 is disposed in compression between the frame 310 and a shoulder 378 on the bar 370. The spring 380 biases the bar 370 toward its locked position and resists movement of the bar 370 into its unlocked position.

The engaging portion 372 of the bar 370 extends rearward to a distal end 376 which may be made accessible to a user. A pulling force exerted on the end 376 frees the wheels 350 for rotation relative to the frame 310. This arrangement allows a person grabbing the bar 309 to operate the locking mechanism 369, as well. The offset portion 373 of the bar 370 extends forward to a distal end 374 which also may be made accessible to a user. A pushing force exerted on the end 374 also frees the wheels 350 for rotation relative to the frame 310. This arrangement allows a person to adjust the wheels 350 relative to the frame 310 without moving the treadmill 300 across the floor surface.

In view of the foregoing, the present invention may be seen as an exercise treadmill, comprising a base designed to rest upon a floor surface; a deck mounted on the base; an endless tread disposed about the deck; a resilient member disposed in series between the deck and the floor surface to absorb energy resulting from a person shifting body weight onto the deck; a means, connected to the resilient member and accessible to a user, for selectively rotating the resilient member relative to the deck. The treadmill may further comprise a biasing means, connected to the resilient member, for selectively biasing the resilient member against rotation relative to the base. The rotating means may include a shaft rotatably mounted on the base, and the biasing means may include a bar which selectively interferes with rotation of the shaft. One said resilient member is rotatably mounted on each side of the base, and each said resilient member occupies a position between the base and the floor surface. Also, each said resilient member is bounded by a cylindrical surface disposed about a longitudinal axis, and each said resilient member has an asymmetrical profile disposed about the axis.

The present invention has been described with reference to specific embodiments and applications. Recognizing that persons skilled in the art are likely to recognize additional embodiments and applications as a result of this disclosure, the scope of the present invention should be construed to include same.

What is claimed is:

1. An exercise treadmill, comprising:

a floor engaging base;

a deck mounted on the base;

an endless tread disposed about the deck;

an energy absorbing means, disposed between the desk and the base, for absorbing energy associated with a person shifting body weight onto the deck, wherein the energy absorbing means is selectively movable relative to the base, and the energy absorbing means has a capacity to absorb energy which is selectively adjusted by movement of the energy absorbing means relative to the base; wherein the energy absorbing means is a resilient member and has an asymmetrical profile viewed along an axis of rotation defined between the resilient member and the base.

2. The treadmill of claim 1, wherein the energy absorbing means is rotatably mounted on the base, and the capacity to absorb energy is a function of relative orientation between the energy absorbing means and the base.

3. The treadmill of claim 1, wherein the energy absorbing means is cylindrical in shape and rotatably mounted on the base.

4. The treadmill of claim 1, wherein the energy absorbing means is a resilient member having an asymmetrical profile.

5. The treadmill of claim 4, wherein the resilient member is a cylinder having a longitudinal axis which extends parallel to the floor surface, and circumferentially distributed openings extend axially into the cylinder.

6. The treadmill of claim 5, wherein respective spokes are disposed between the openings, and at least two spokes have different widths, as measured perpendicular to respective radii extending perpendicularly from the longitudinal axis.

7. The treadmill of claim 6, wherein the spokes extend radially outward from a hub, and the hub receives a shaft, and the shaft is rotatably mounted on the base.

8. The treadmill of claim 5, wherein each of the openings has a different width, as measured perpendicular to respective radii extending perpendicularly from the longitudinal axis.

9. The treadmill of claim 1, wherein the energy absorbing means includes elastomeric wheels, each of the wheels having an asymmetrical profile bounded by a circle.

10. An exercise treadmill, comprising:

a floor engaging base;

a deck mounted on the base;

an endless tread disposed about the deck;

a resilient member rotatably mounted on the base and disposed immediately beneath the deck, wherein the resilient member is rotatable about an axis; whereby the resilient member absorbs an amount of energy which is a function of its orientation relative to its axis and has an asymmetrical profile disposed about the axis.

11. The treadmill of claim 10, further comprising a biasing means, connected to the resilient member, for selectively biasing the resilient member against rotation relative to the base.

12. The treadmill of claim 11, wherein the resilient member has a first energy absorbing capacity when biased to remain in a first orientation relative to the base, and the resilient member has a second energy absorbing capacity when biased to remain in a second orientation relative to the base.

13. The treadmill of claim 11, wherein the biasing means includes nubs on the resilient member and corresponding holes in the base.

14. The treadmill of claim 10, wherein circumferentially distributed openings extend axially into the resilient member and define respective spokes therebetween, and at least two spokes have different widths, as measured parallel to respective tangents to the axis.

* * * * *